US007222679B1

(12) United States Patent
Dohogne

(10) Patent No.: US 7,222,679 B1
(45) Date of Patent: May 29, 2007

(54) RANDOM ORBITAL SANDER

(75) Inventor: Dennis A. Dohogne, Blairsville, GA (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 11/276,936

(22) Filed: Mar. 17, 2006

(51) Int. Cl.
*B24B 23/04* (2006.01)

(52) U.S. Cl. ..... 173/170; 451/344; 451/357; 15/97.1; 16/430

(58) Field of Classification Search ..... 451/344, 451/354, 358, 357, 359; 173/170, 168; 15/28, 15/97.1, 98; 16/430
See application file for complete search history.

(56) References Cited

U.S. PATENT DOCUMENTS

| | | | | |
|---|---|---|---|---|
| 4,239,428 | A * | 12/1980 | Berzina | 409/182 |
| 4,783,872 | A * | 11/1988 | Burhoe | 15/98 |
| 5,176,478 | A * | 1/1993 | Munch | 409/137 |
| 5,231,727 | A * | 8/1993 | Armbruster | 15/97.1 |
| D354,425 | S | 1/1995 | Izumisawa | |
| D356,017 | S | 3/1995 | Izumisawa | |
| 5,445,558 | A * | 8/1995 | Hutchins | 451/344 |
| 5,466,183 | A * | 11/1995 | Kirn et al. | 451/359 |
| 5,709,596 | A * | 1/1998 | Alexander et al. | 451/357 |
| 5,725,422 | A * | 3/1998 | Leweck | 451/359 |
| 6,148,931 | A * | 11/2000 | Nyber et al. | 173/170 |
| 6,266,850 | B1 * | 7/2001 | Williams et al. | 16/430 |
| 6,394,885 | B2 | 5/2002 | Georgiou | |
| D458,102 | S | 6/2002 | Tseng | |
| 6,725,491 | B2 * | 4/2004 | Hung | 15/97.1 |
| D494,434 | S | 8/2004 | Sun et al. | |
| 6,810,547 | B2 * | 11/2004 | Hung | 15/28 |
| 6,855,040 | B2 | 2/2005 | Huber | |
| 6,979,254 | B1 | 12/2005 | Huber | |
| 7,101,274 | B1 * | 9/2006 | Etter et al. | 451/344 |
| 2002/0111127 | A1 | 8/2002 | Tseng | |
| 2003/0083005 | A1 | 5/2003 | Price et al. | |
| 2003/0143935 | A1 | 7/2003 | Huber | |
| 2004/0203329 | A1 | 10/2004 | Lin | |
| 2005/0020196 | A1 | 1/2005 | Chen et al. | |

* cited by examiner

*Primary Examiner*—Scott A. Smith
(74) *Attorney, Agent, or Firm*—Barnes & Thornburg LLP

(57) ABSTRACT

A random orbital sander including an adjustable contoured hand grip that is removably coupled to the sander housing. The hand grip is repositionable with respect to the housing to provide various contour griping services engageable by an operator's hand. The adjustable hand grip, when used in combination with a random orbital sander, provides various contoured gripping surfaces that can be adjusted to fit the hands of various users. The perimeter of the hand grip includes a contoured irregular surface that can be rotated or repositioned with respect to the housing to provide various shaped gripping surfaces. The random orbital sander includes a housing with an internal cavity arranged to accept a motor within the housing. The motor includes an output shaft that can be coupled to a sanding pad or other structure. The upper end of the housing is adapted to accept an adjustable contoured hand grip that is adapted to be repositionable with respect to the housing to provide various contoured gripping surfaces engageable by an operator's hand. The hand grip includes a cavity that is adapted to be coupled to the housing. The cavity includes a plurality of retention members that are adapted to maintain the position of the hand grip with respect to the housing.

15 Claims, 8 Drawing Sheets

RANDOM ORBITAL SANDER

BACKGROUND

The present disclosure relates to hand operated power tools, and, in particular, to adjustable hand grips for use with power tools. More particularly, the present disclosure relates to an adjustable contoured hand grip for use with a random orbital sander. Random orbital sanders typically include a fixed handle molded to the sander housing that cannot be adjusted.

A random orbital sander, in accordance with the present disclosure, includes an adjustable contoured hand grip that is removably coupled to the sander housing. The hand grip is positionable with respect to the housing to provide various contour gripping surfaces engageable by an operator's hand. The adjustable hand grip, when used in combination with a random orbital sander, provides various contoured gripping surfaces that can be adjusted to fit the hands of various users. As shown in the illustrative embodiments, the perimeter of the hand grip includes a contoured irregular surface that can be rotated or repositioned with respect to the housing to provide various shaped gripping surfaces.

According to the present disclosure, the hand operated random orbital sander includes a housing with an internal cavity arranged to accept a motor within the housing. The motor includes an output shaft that can be coupled to a sanding pad or other structure. The upper end of the housing is adapted to accept an adjustable contoured hand grip that is adapted to be repositionable with respect to the housing to provide various contoured gripping surfaces engageable by an operator's hand. The hand grip includes a cavity that is adapted to be coupled to the housing. The cavity includes a plurality of retention members that are adapted to maintain the position of the hand grip with respect to the housing.

Also in accordance with the present disclosure, the hand operated random orbital sander also includes a color coded lock ring with indicia that is removably coupled to the housing to identify and provide information regarding the operating characteristics of the power tool. The color coded lock ring with indicia allows users to identify a specific random orbital sander and identify whether the sander includes proper motor orbit for particular sanding purpose. Also in accordance with present disclosure, the random orbital sander further includes a housing that includes alignment indicia to assist in properly aligning the motor with respect to the housing when the motor is installed within the housing. The random orbital sander, when used with a particular matter collection system, can include a rotatable nipple having an exterior surface with a first diameter and a second diameter. The first diameter of the nipple is greater than the second diameter to accept different diameter vacuum hoses.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The present invention and the advantages thereof will become more apparent upon consideration of the following detailed description when taken in conjunction with the accompanying drawings of which.

DETAILED DESCRIPTION

Figure 1:
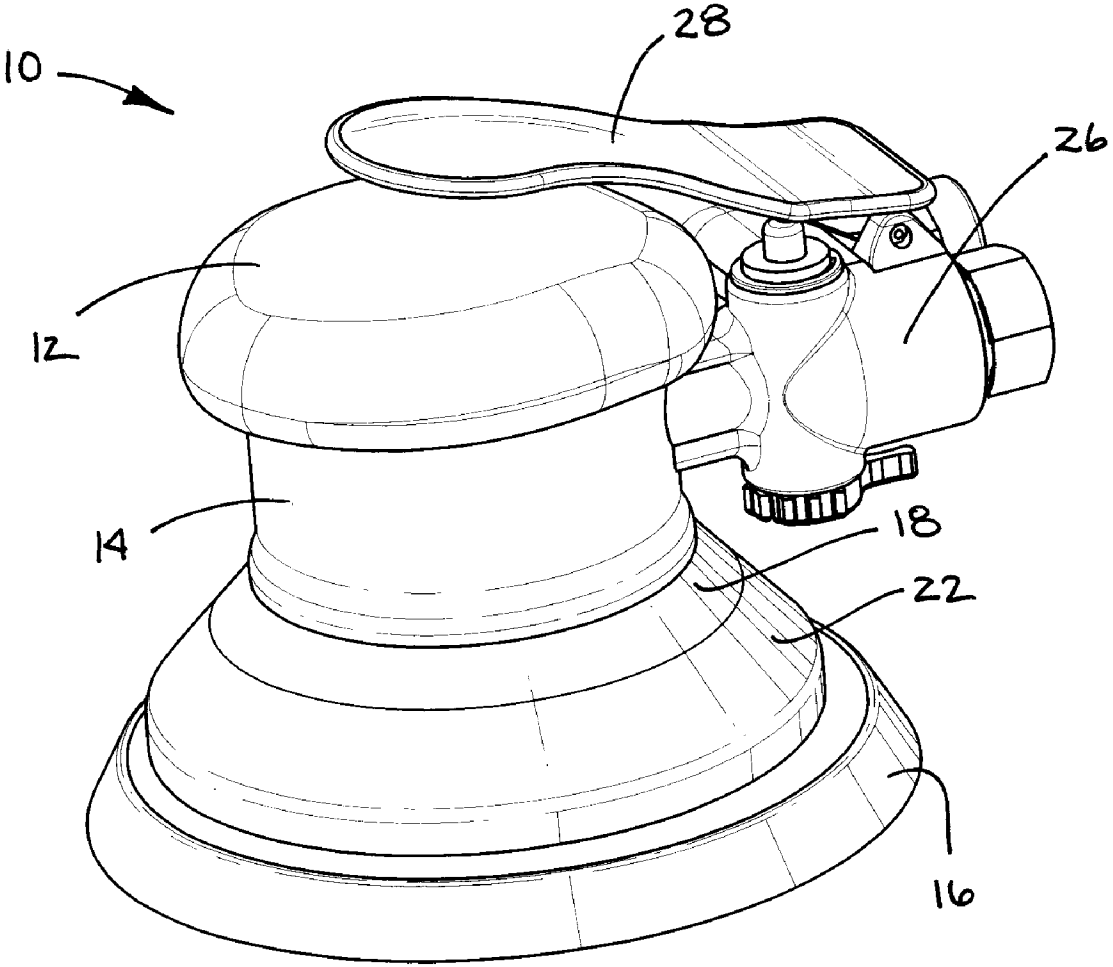
FIG. 1 is a perspective view of an orbital sander including an illustrative embodiment of the adjustable hand grip coupled to the housing of the sander and further illustrating a contoured actuation lever in accordance with the present disclosure.

While the present disclosure may be susceptible to embodiment in different forms, there are shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

A random orbital sander 10, in accordance with the present disclosure, includes an adjustable contoured hand grip 12, coupled to a housing 14, as shown, for example in FIG. 1, that can be repositioned with respect to the housing 14 to provide various contoured gripping surfaces engageable by an operators hand. The ability to reposition the hand grip 12 with respect to the housing 14 of the random orbital sander 10 provides a greater degree of comfort for the operator. Power tools, and in particular random orbital sanders are used by a variety of professionals to perform sanding functions for their craft. The adjustable hand grip 12, of the present disclosure, provides for various contoured gripping services so that an operator can orient the grip to a position that is most comfortable for their hand.

In an illustrative embodiment of FIG. 1, the random orbital sander 10 includes the housing 14 having the adjustable hand grip 12 at a first end. While the housing 14 is shown as cylindrical, it can be formed in other configurations while still keeping within the scope of this disclosure. Connected to the second end of the housing is a lock ring 18 that is adapted to secure a motor 20 within the housing 14, as shown, for example in the illustrative embodiment of FIG. 12. The random orbital sander 10 also includes a particulate matter collection skirt 22 that is coupled to the lock ring 18. The particulate matter collection skirt 22 is adapted to contain particulate matter created by the sander and, when used with a vacuum attachment 24, can be used to allow the dust the be collected by a vacuum unit, as shown, for example, in FIG. 13. Located adjacent the particulate matter collection skirt is a sanding pad 16 that is coupled to the motor 20. The housing 14 also includes an valve assembly 26 that is adapted to be connected to a pressurized air supply. The valve assembly 26 is operated by depressing actuation lever 28. While the housing 14 is preferably made from plastic it can also be manufactured metal, such as aluminum, or other materials.

Figure 3:
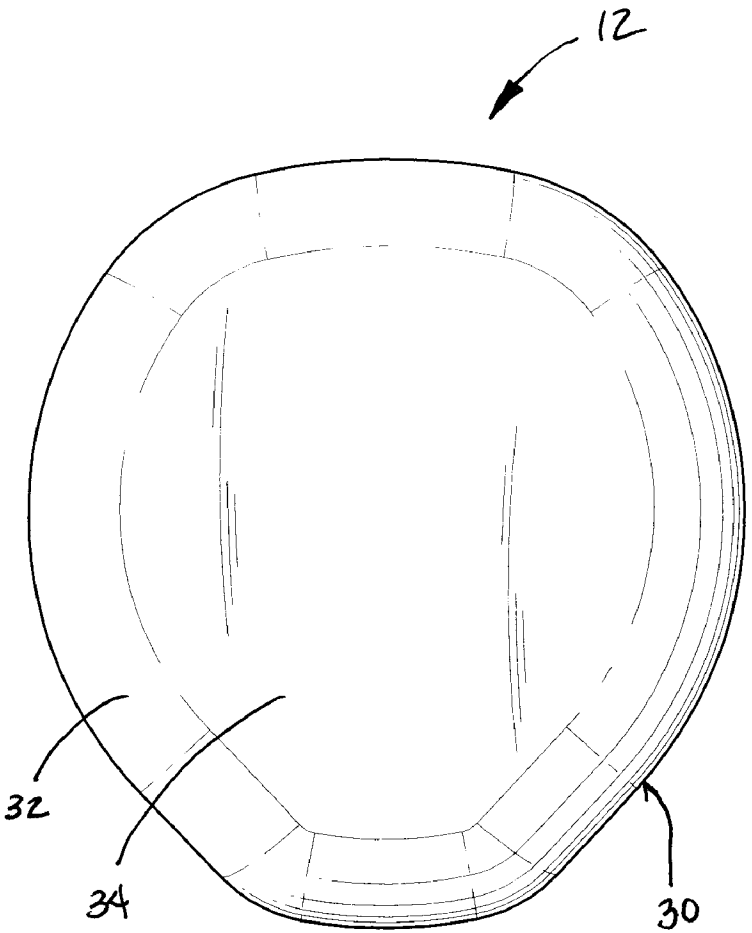
FIG. 3 is a perspective view of the top side of the adjustable hand grip, including an illustrative embodiment of the contoured perimeter of the hand grip.
Figure 2:
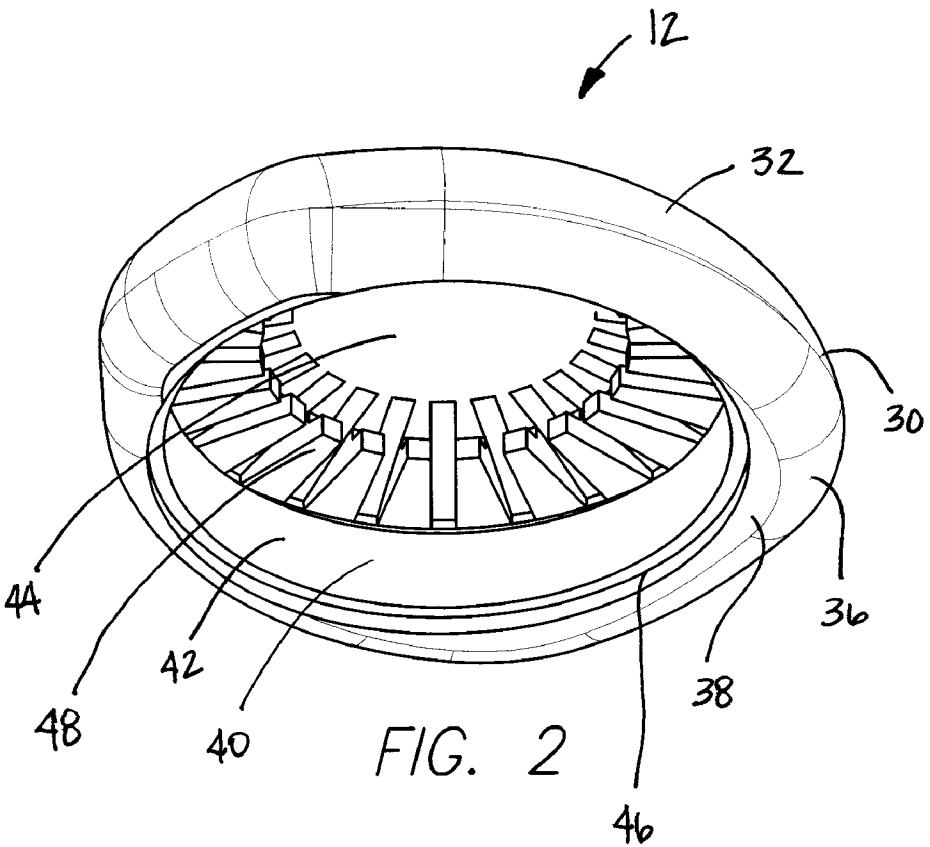
FIG. 2 is a perspective view of the bottom side of the adjustable hand grip, including an illustrative embodiment of a plurality of retention members used to retain the position of the hand grip with respect to the housing of the sander.
Figure 5:
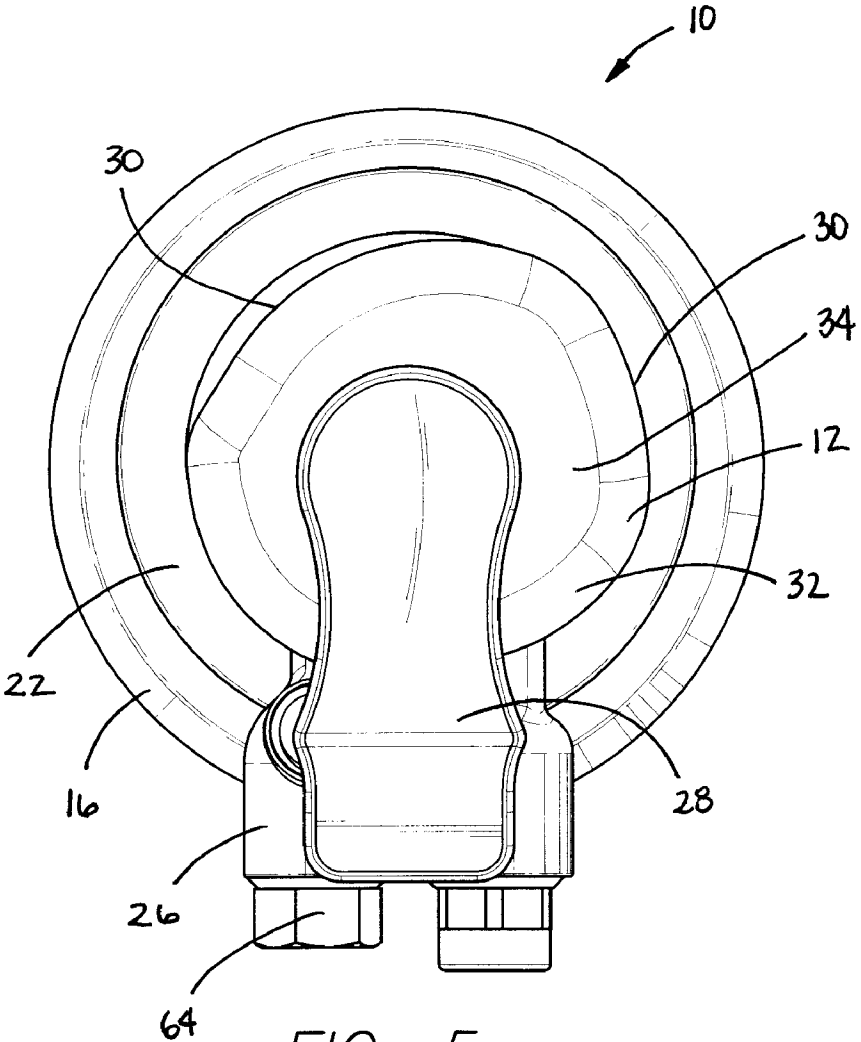
FIG. 5 is a top view of the sander illustrating the hand grip of the sander in a second position with respect to the housing of the sander, wherein the leading edge of the grip includes a second contoured surface.
Figure 4:
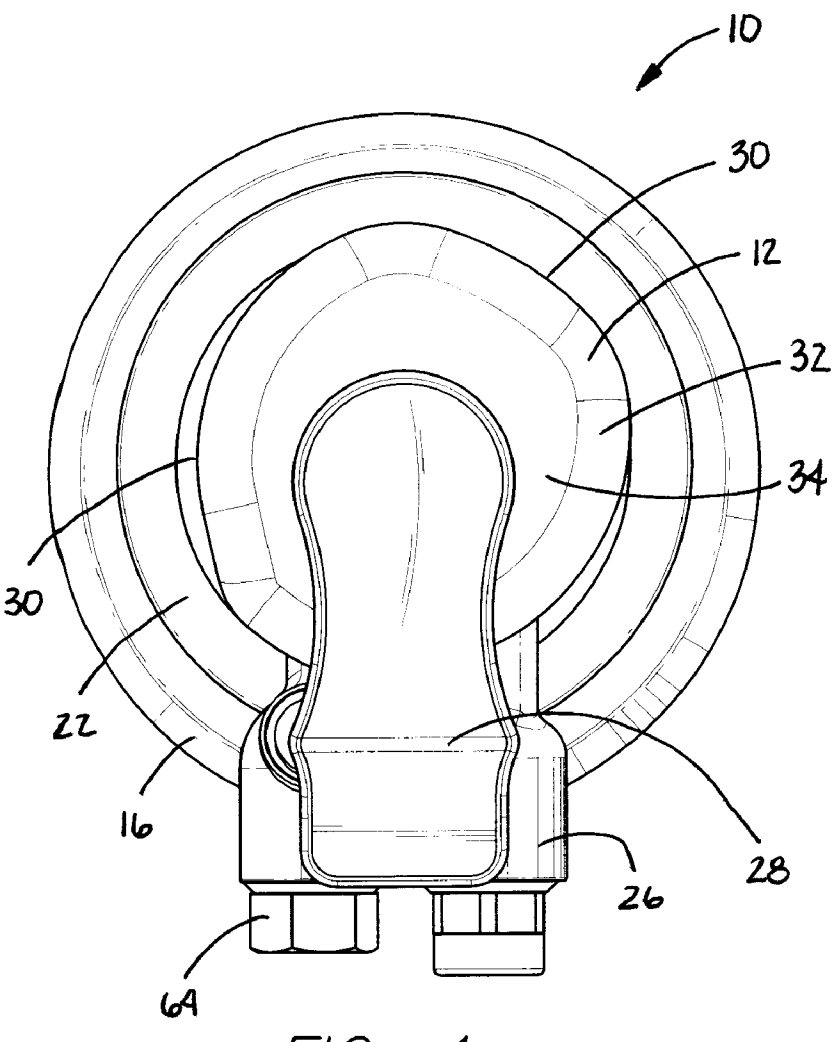
FIG. 4 is a top view of the sander illustrating the hand grip of the sander in a first position with respect to the housing of the sander, wherein the leading edge of the grip includes a first contoured surface.

The adjustable hand grip 12 of the random orbital sander 10 includes a perimeter 30 that is formed with a contoured irregular surface such that the radius of curvature of the perimeter varies at different points along the perimeter as shown, for example, in FIGS. 2 and 3. In addition, the perimeter 30 of the hand grip 12 includes a first curved surface 32 that transitions into a top surface 34. The perimeter 30 also includes a second curved surface 36 that transitions into the bottom 38 of the hand grip 12. The hand grip 12, as shown in the illustrative embodiments, is preferably manufactured from pliable elastomeric materials to provide additional comfort for the operator but can also be manufactured from various types of polymers.

The bottom 38 of the hand grip 12 includes a cavity 40. The cavity 40 includes an annular wall 42 and a top surface 44. The wall 42 includes an annular ridge 46 that is adapted to engage a corresponding structure on the housing 14. The top surface 44 of the cavity 40 includes a plurality of outwardly extending retention members 48 that are designed to engage corresponding detents (not shown) on the housing to maintain the position of the hand grip 12 with respect to the housing 14. The retention members in the illustrative embodiment of FIG. 2 are in the form of radially extending protrusions that engage the corresponding structure on the housing 14. The retention members 48 are preferably made from a pliable material so that force exerted on the exterior of the hand grip 12 overcomes the retention force of the retention members 48 to permit rotation of the handgrip 12 with respect to the housing 14. The ridge 46 within the cavity 40 prevents unintentional disconnection of the hand grip 12 from the housing 14. Alternatively, the hand grip can be repositioned by uncoupling the hand grip 12 from the housing 14, rotating the hand grip 12 to a desired position, and reinstalling the handgrip 12 onto the housing 14. While radially extending protrusions are shown in the illustrative embodiment of FIG. 2, other retention means can be used to retain the position of the hand grip with respect to the housing 14.

Figure 7:
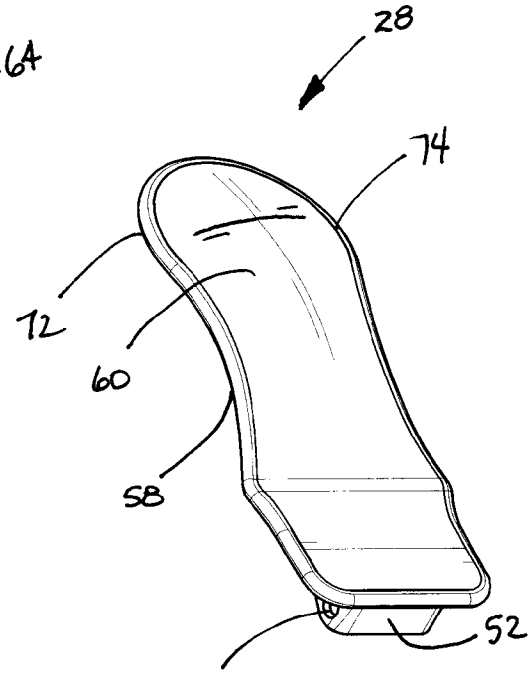
FIG. 7 is a perspective view of the actuation lever of FIGS. 1 and 6, illustrating the contoured and curved palm engagement surface.
Figure 6:
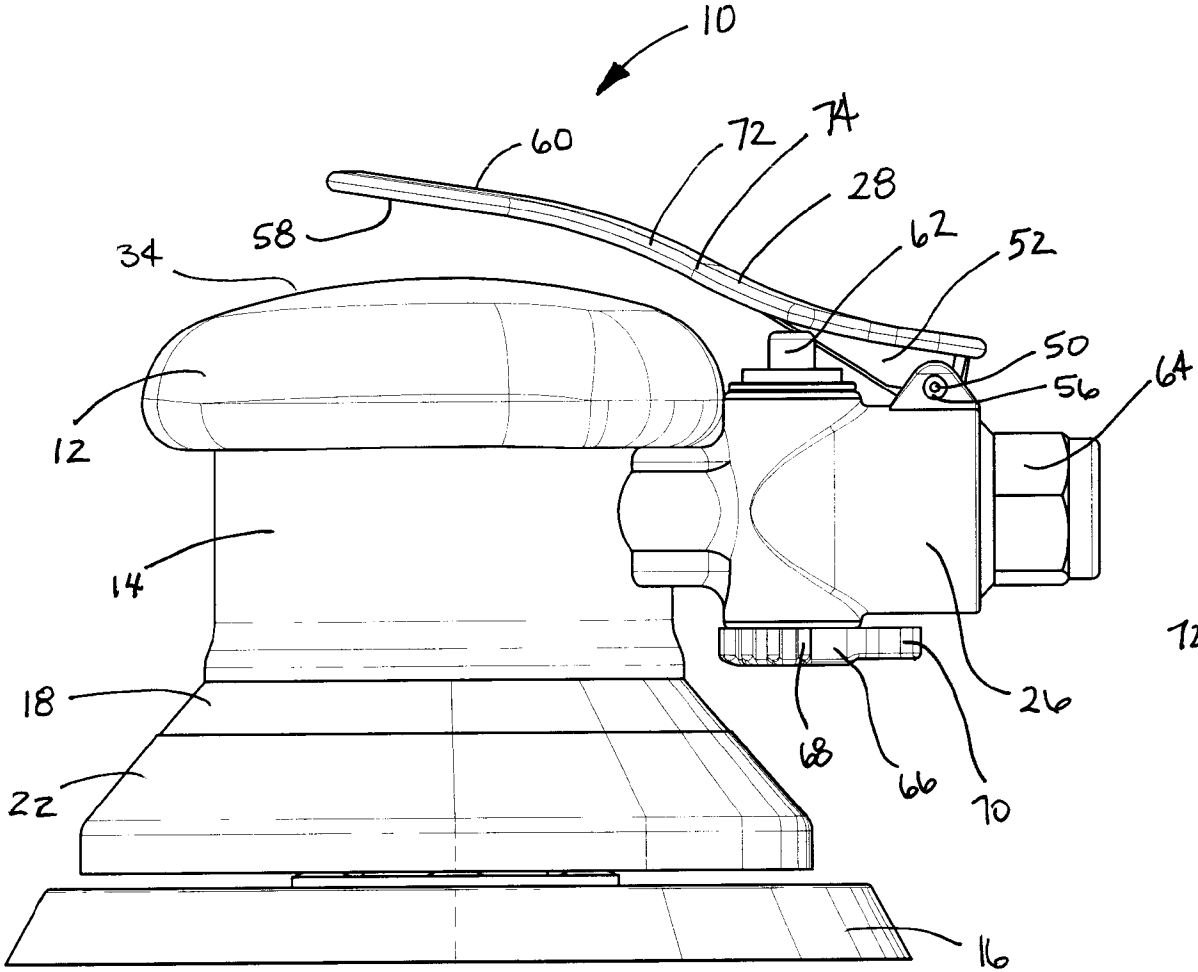
FIG. 6 is a side elevational view of the orbital sander with the hand grip coupled to the housing and the actuation lever positioned above the housing.

The actuation lever 28 of the random orbital sander 10 is secured to the valve 26 at pivot 50. The actuation lever 28 includes bracket 52 having an aperture 54 to accept pin 56. The actuation lever 28 includes a curved profile, as shown in the illustrative embodiment of FIG. 6, and includes a bottom surface 58 and a convex or curved top surface 60. The top surface 60 of the actuation lever 28 is curved to conform to the palm of an operator's hand to reduce fatigue and discomfort when operating the random orbital sander 10. The curved profile also conforms to the top surface 34 of the hand grip 12. The bottom surface 58 of the actuation lever 28 is also designed to engage and depress valve pin 62 to permit pressurized air to flow through the valve assembly 26 into the housing 14 to rotate the motor 20. The perimeter 72 of the actuation lever 28 can include a soft edge 74 that surrounds the perimeter of the actuation lever 28 to increase comfort for the operator as shown, for example, in FIG. 7. An air supply line can be secured to the valve assembly 26 by use of fitting 64. Positioned adjacent the fitting 64 is exhaust port 102. The valve assembly 26 also includes an internal regulator that is controllable by rotation of knob 66. The knob 66 of the valve assembly 26 includes protrusions 68 and a thumb lever 70 to permit rotation by an operator's thumb.

Figure 8:
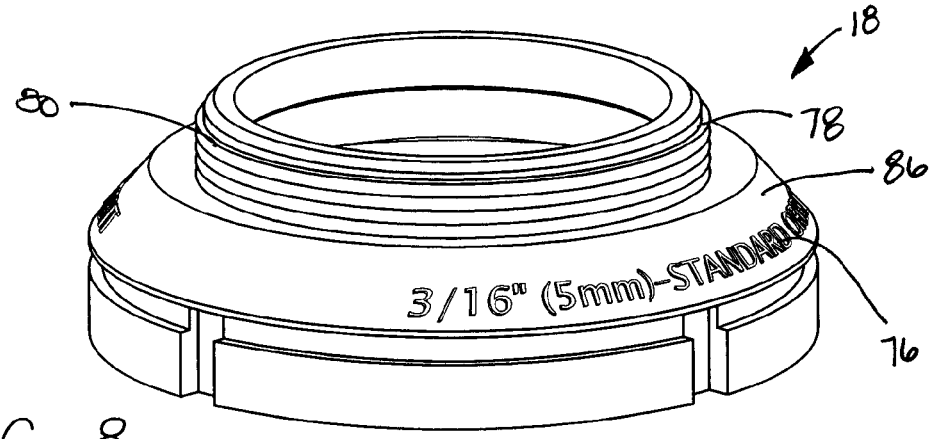
FIGS. 8–10 are perspective views of illustrative embodiments of lock rings with indicia to indicate sander operating characteristics including the diameter of the motor orbit.
Figure 9:
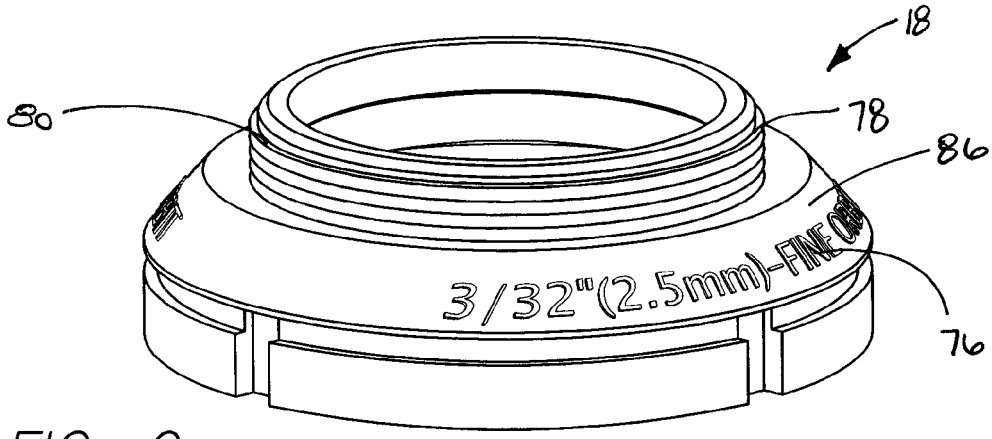
Figure 10:
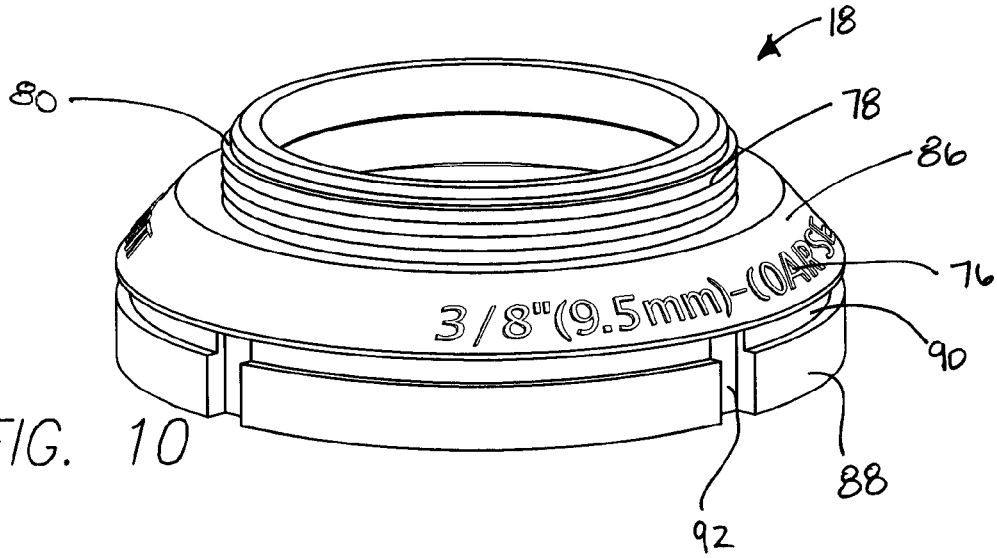
Figure 12:
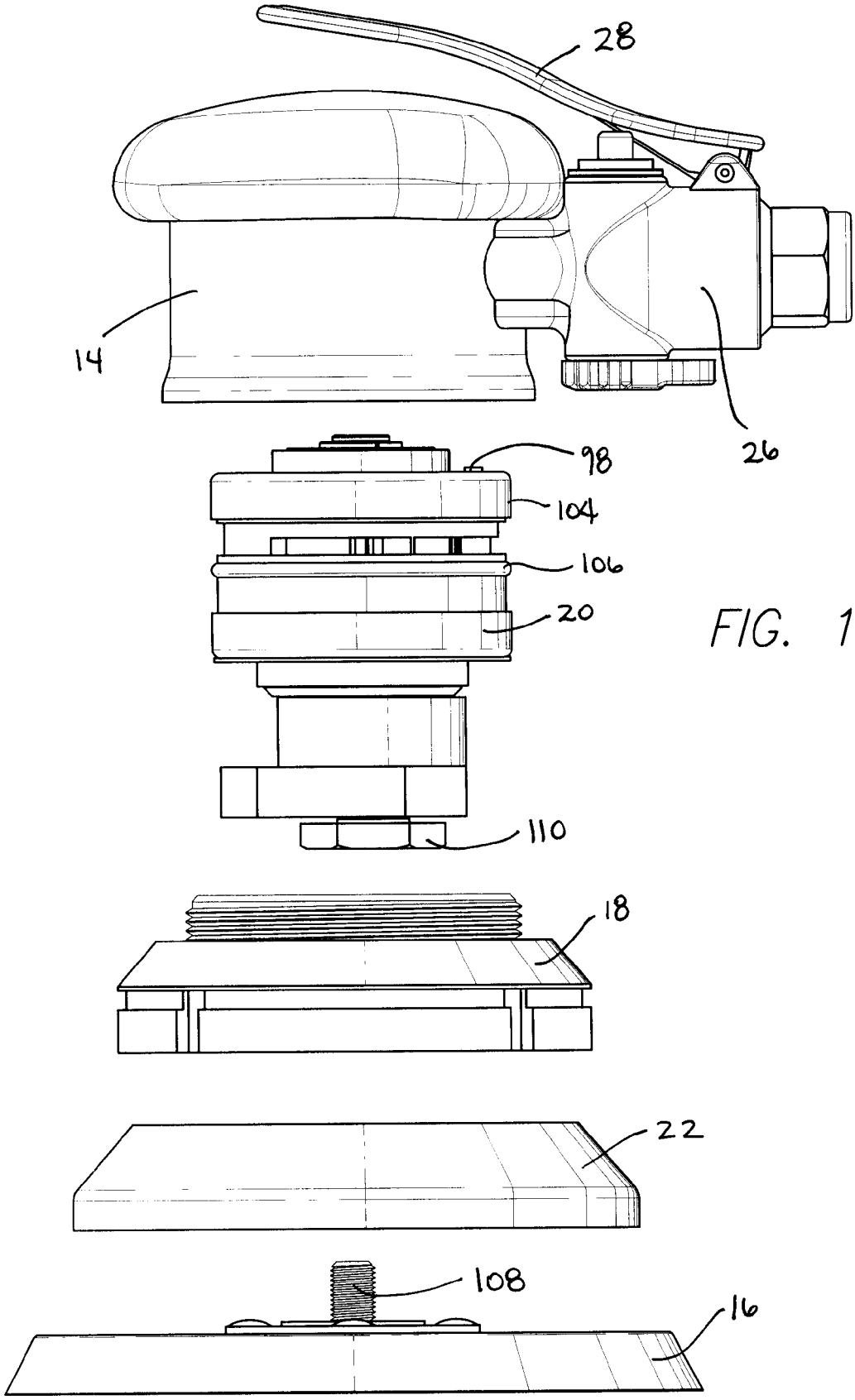
FIG. 12 is an exploded view of the orbital sander illustrating the hand grip coupled to the housing, followed by the motor, lock ring, dust skirt and sanding pad.
Figure 13:
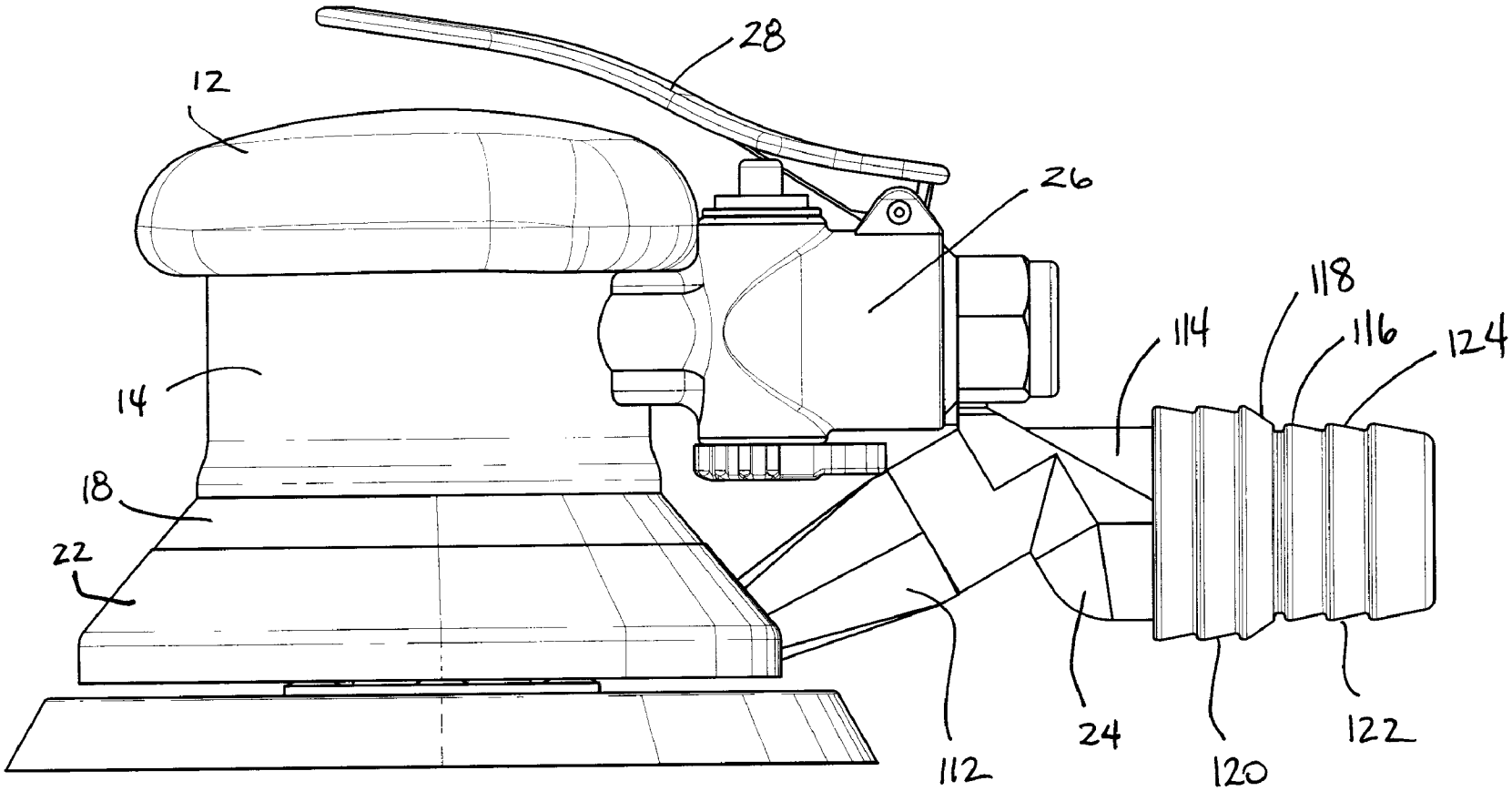
FIG. 13 is a perspective view of the orbital sander including a vacuum port coupled to the dust skirt that includes an illustrative embodiment of a barbed nipple having two outer diameters to accept various diameter vacuum hoses.

The lock ring 18, as best shown in the illustrative embodiments of FIGS. 8 and 12, is used to secure the motor 20 within the housing 14 of the random orbital sander 10. The lock ring 18, of the preferred embodiment, is colored and includes written indicia 76 in the form of letters and numbers to allow an operator to quickly identify the sander and determine operating characteristics, such as the orbit of the motor. As an example, the lock rings 18 of FIGS. 8 through 10 each include different indicia that identifies a particular orbit for a sander. Also, the lock ring of FIG. 8 may be colored blue while the lock rings 18 of FIGS. 9 and 10 may be colored yellow and red to reduce the likelihood that the operator would use the wrong sander while working. While the lock ring 18 is the portion of the sander 10 that is color coated with indicia, it is contemplated that other components of the sander could be color coated with corresponding indicia to indicate operating characteristics or features of a random orbital sander 10. The lock ring 18 includes a top portion 78 that includes a plurality of threads 80 that are adapted to engage corresponding threads 82 formed on wall 84 on the inside of the housing 14. The lock ring 18 also includes a tapered wall portion 86 that includes the indicia 76. The lock ring 18 further includes a lower portion 88 that includes a circumferential groove 90 and vertical recessions 92 to accept the particulate matter collection skirt 22.

Figure 11:
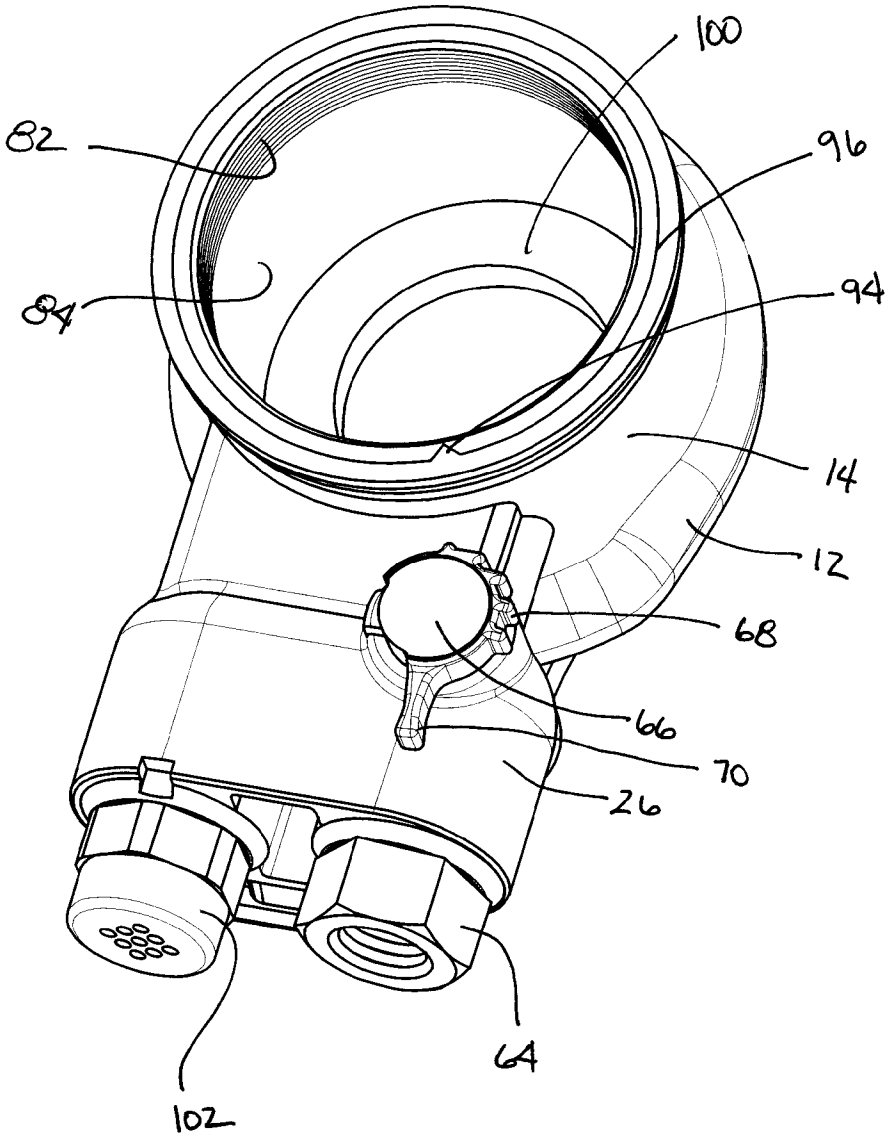
FIG. 11 is a perspective view of the bottom side of the sander housing illustrating a motor alignment marking in the form of a "V" on the perimeter of the housing to assist in properly installing the motor into the housing.

The housing 14 of the random orbital sander 10 includes alignment indicia 94 located on the bottom edge 96 of the housing 14. The alignment indicia 94, as shown in the illustrative embodiment of FIG. 11, is molded into the housing 14 to allow for proper positioning of the motor 20 within the housing 14. While molding is preferred, the alignment indicia 94 can also be printed and is desirably contrasted from its surroundings. The motor 20, as shown in the illustrative embodiment of FIG. 12, includes an alignment pin 98 that is adapted to be positioned within an aperture (not shown) on the bottom surface 100 of the housing 14. When installing the motor 12 the pin 98 is aligned with the alignment indicia 94. Once the pin 98 is aligned with the indicia 94 the motor is lowered vertically into the housing 14. Alignment of the motor 20 with respect to the housing 14 is crucial so that air passageways within the housing are aligned with the air passageways of the motor 20. Improper alignment of the motor 20 with respect to the housing causes improper operation or non-functionality of the motor. Also illustrated in the illustrative embodiment of FIG. 11 is exhaust port 102 that permits the exhausting of compressed air from the motor 20 of random orbital sander 10. The motor 20 of the random orbital sander 10 includes external wall 104 with seal 106. The wall 104 and seal 106 are adapted to engage the wall 84 of the housing 14 to create an air tight seal to prevent air leakage from the housing 14. The motor 20, when positioned within the housing, is retained by threading lock ring 18 into the housing 14. The sanding pad 16, as shown for example in FIG. 12, includes a threaded post 108 that is adapted to engage fitting 110 on the motor 20.

If it is desirable to remove particulate matter from the work area. A vacuum attachment 24 can be used in conjunction with the particulate matter collection skirt 22 to permit the attachment of a vacuum supply. The vacuum attachment 24, as shown, for example, in FIG. 13 includes a tapered housing 112 that connects to a passageway 114. Coupled to the passageway 114 is a nipple 116. The nipple 116 includes an exterior surface 118 having a first diameter 120 and a second diameter 122 wherein the first diameter is greater than the second diameter. The varying diameters of the nipple 116 permit attachment of the random orbital sander 10 to vacuum hoses of varying diameters. The exterior surface 118 of the nipple 116 also includes barbs 124 that assist in retaining the vacuum hose to the nipple 116 and in the preferred embodiment the nipple 116 is rotatably secured to the passageway 114 to permit rotation of the nipple 116 with respect to the passageway 114.

In use, the operator selects the random orbital sander 10 with a proper motor orbit by looking at the indicia printed on the colored lock ring 18. Once the proper sander 10 is selected, the operator can adjust the hand grip 12 by either removing the hand grip 12 from the housing 14 and reinstalling the hand grip 12 in the desired position or rotating the hand grip with a force great enough to overcome the retaining force of retention members 48 located within the cavity 40 of the hand grip 12. Once the proper hand grip position has been selected the operator places their fingers around the perimeter of the hand grip 12 with their palm positioned over the top surface 60 of the actuation lever 28. To use the sander 10 an air supply line must be connected to the fitting 64 of the valve assembly 26. With the air supply line properly connected, the operator can operate the sander by depressing the actuation lever 28 against the top surface 34 of the hand grip 12. Movement of the actuation lever 28 causes depression of valve pin 62 permitting compressed air to flow into the housing 14 to rotate the motor 20. Compressed air to the motor 20 causes the motor 20 to rotate sanding pad 16. With a vacuum hose connected to the nipple 116 particulate matter created by the sanding process passes through apertures (not shown) of the sanding pad 16 into the particulate matter collection skirt 22 and through the vacuum attachment 24. Air entering the valve assembly 26 is regulated by rotation of knob 66, to control the speed of the motor 20.

While embodiments have been illustrated and described in the drawings and foregoing description, such illustrations and descriptions are considered to be exemplary and not restrictive in character it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as containing or implying limitation of the disclosure to those embodiments. There are a plurality of advantages of the present disclosure arising from various features set forth in the description. It will he noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

What is claimed is:

1. A hand operated power tool comprising a housing;

a motor positioned within the housing;

an adjustable contoured hand grip coupled to the housing only by the shape of the hand grip, the hand grip including means for allowing repositioning of the hand grip with respect to the housing to provide various contoured gripping surfaces engagable by an operator's hand.

2. The hand operated power tool of claim 1, wherein the perimeter of the hand grip includes a contoured irregular surface.

3. The hand operated power tool of claim 1, wherein the hand grip can be removed from, rotated with respect to the housing, and reattached to the housing.

4. A hand operated power tool comprising a housing having a contoured shape;

a motor positioned within the housing;

an adjustable contoured hand grip coupled to the housing only by a shape corresponding to the contoured shape of the housing, the hand grip including means for allowing repositioning of the hand grip with respect to the housing to provide various contoured gripping surfaces engagable by an operator's hand.

5. A hand operated power tool comprising a housing having a contoured shape and detents, a motor positioned within the housing, a pliable hand grip having a generally annular shape, a top surface, a bottom, a cavity, retention members extending inwardly to the cavity and a perimeter, the retention members engaging corresponding detents on the housing, whereby the hand grip can be removed from, rotated with respect to the housing, and reattached to the housing, and wherein rotational force applied to the hand grip overcomes connection between the grip retention members and the housing detents to permit rotation of the hand grip with respect to the housing.

6. The hand operated power tool of claim 5, wherein the retention members are in the form of radially extending protrusions that engage a corresponding structure on the housing.

7. The hand operated power tool of claim 6, wherein rotational force applied to the hand grip overcomes the connection between the protrusions of the grip and the housing to permit rotation of the hand grip with respect to the housing.

8. The hand operated power tool of claim 5, wherein the hand grip is formed from an elastomeric material.

9. The hand operated power tool of claim 5, further including an air actuation lever curved to generally conform to the shape of the contoured hand grip.

10. The hand operated power tool of claim 5, further including a removable color coded member to identify operating characteristics of the power tool.

11. The hand operated power tool of claim 10, wherein the removable color coded member includes indicia to provide information regarding operating characteristics of the power tool.

12. The hand operated power tool of claim 5, wherein the hand grip can be removed from the housing, rotated and repositioned on the housing in a desired orientation.

13. The hand operated power tool of claim 5 wherein the hand grip comprises an annular ridge adapted to engage a corresponding structure on the housing.

14. The hand operated power tool of claim 5, wherein the retention members are radially extending protrusions that engage a corresponding structure on a power tool.

15. The hand operated power tool of claim 5, wherein the perimeter comprises a contoured irregular surface such that a radius of curvature of the perimeter varies at different points along the perimeter.

* * * * *